US009943857B1

(12) United States Patent
Reed

(10) Patent No.: US 9,943,857 B1
(45) Date of Patent: Apr. 17, 2018

(54) LOUVERED SLUICE

(71) Applicant: Frank E. Reed, Hayden, ID (US)

(72) Inventor: Frank E. Reed, Hayden, ID (US)

( * ) Notice: Subject to any disclaimer, the term of this patent is extended or adjusted under 35 U.S.C. 154(b) by 0 days.

(21) Appl. No.: 15/260,183

(22) Filed: Sep. 8, 2016

Related U.S. Application Data

(60) Provisional application No. 62/215,282, filed on Sep. 8, 2015.

(51) Int. Cl.
*B03B 5/06* (2006.01)
*B03B 5/26* (2006.01)

(52) U.S. Cl.
CPC . *B03B 5/26* (2013.01); *B03B 5/06* (2013.01)

(58) Field of Classification Search
CPC .... B03B 5/00; B03B 5/06; B03B 5/08; B03B 5/26
USPC ..... 209/44, 44.2, 443, 493
See application file for complete search history.

(56) References Cited

U.S. PATENT DOCUMENTS 2,015,522 A * 9/1935 Hoffman ..... B03B 5/32 209/205
2,646,882 A * 7/1953 Frost, Jr. ..... B03D 1/06 209/170
2,787,453 A * 4/1957 Hibshman ..... B01D 3/24 202/158
2,923,410 A * 2/1960 Tschmelitsch ..... B03B 5/06 209/484
4,284,499 A * 8/1981 Moudgil ..... B03D 1/00 209/166
4,344,844 A * 8/1982 Townley ..... B03B 1/04 209/1
4,863,588 A * 9/1989 Herron ..... B03B 5/26 209/44
5,617,955 A * 4/1997 Tanner ..... B03B 5/26 209/458
5,632,935 A * 5/1997 Yeoman ..... B01D 3/163 261/114.1
6,799,681 B1 * 10/2004 Warren ..... B03B 5/26 209/268
8,678,192 B1 * 3/2014 Pung ..... B03B 5/26 209/18

* cited by examiner

*Primary Examiner* — Joseph C Rodriguez
(74) *Attorney, Agent, or Firm* — Law Office of Craig Bohn; Craig E. Bohn

(57) ABSTRACT

A mining sluice box having a louver processing zone comprising a plurality of louvers positioned perpendicular to the incline slope, with the pitch angle of the louvers being variable so as to permit adjustment of the intensity of a vortex flow between the plurality of louvers by adjusting the pitch angle of the plurality of louvers.

2 Claims, 7 Drawing Sheets

LOUVERED SLUICE

CROSS-REFERENCE TO RELATED APPLICATIONS

This application claims the benefit of patent application No. 62/215,282, filed 8 Sep. 2015 by the present inventor.

STATEMENT REGARDING FEDERALLY SPONSORED RESEARCH OR DEVELOPMENT

Not Applicable

BACKGROUND OF THE INVENTION

Field of the Invention

This invention generally relates to the field of gold or gem mining, and more specifically to sluice box concentrators.

Description of the Related Art

A number of methods are typically used to mine gold and gems from the earth's surface. In this disclosure, the material being mined may be referred to simply as "gold," but other heavy metals, valuable materials and gems may still be includable in that term. This disclosure will also use the term "mining material" to refer to the mix of gold and non-gold naturally found at a mining site. The simplest technique to separate gold from the non-gold material is panning. In panning some deposit material is placed in a large plastic or metal pan, along with a generous amount of water. The pan is then agitated so that the gold particles, being of higher density than the non-gold material, settle to the bottom. The non-gold material is flushed from the pan with the water, leaving the desired gold left in the bottom of the pan. Concentric, circumferential ribs are frequently added to the sides of the pan to provide additional low spots for the gold to settle during agitation.

The agitation in a pan can be circular or linear, and is caused by the motion of the pan in the hands of the miner. The waves created by the motion accelerate the non-gold particles, and keep them suspended, while the denser settle to the low spots in the pan.

Sluice boxes and rocker boxes work on a similar principle, just on a slightly larger scale. Rocker boxes tend to be slightly smaller, and both the deposit material and water are generally fed by hand. Improvements include using a filter blanket on the bottom of the box to capture the fine pieces of gold. Sluice boxes, as their name implies, are fed by a sluice, or water flow. Parallel ridges on the bottom of the sluice box, perpendicular to the flow of water, trap the heavier gold particles as the water washes them, while the non-gold material is removed with the water. The pitch of the sluice box and the rate of the water flow can be adjusted to optimize capture of the particular size of gold particles in the deposit material.

The side to side agitation of the rocker box, and the latter will slow agitation of the sluice box, both are seen to create horizontal swirls, or vortices, that agitate the deposit material. The non-gold material is accelerated in the swirled flow, and thereby continues to be suspended in the swirling water. The gold, however, because it is being denser, resists the swirling motion and settles in the low spots in the boxes.

It would be a valuable addition to the prior art for a sluice box to have adjustable ridges within the box to controllably adjust the ridges, and thereby how they disturb the water flow carrying the deposit material, and in so adjusting the flow disturbance, adapt the sluice box to recover valuable material from the deposit material more effectively.

BRIEF DESCRIPTION OF THE DRAWINGS

The invention will be explained in conjunction with an illustrative embodiment shown in the accompanying drawings, in which.

DESCRIPTION OF THE ILLUSTRATED EMBODIMENT

In this description the terms down, downward, top, bottom, lower, higher, up, and upward are used from the perspective of the lift station being in an operational configuration and position, and are in reference to a relationship to the ground. As such downward words mean in the direction toward the ground, as in the direction of gravitational force, and upward words mean in the direction opposite the gravitational force, as toward the sky. The term "parallel to the ground" is used as the non-inclusive transition plane between up and down. As such, and increase in elevation may be understood to be an upward direction.

Figure 1A:
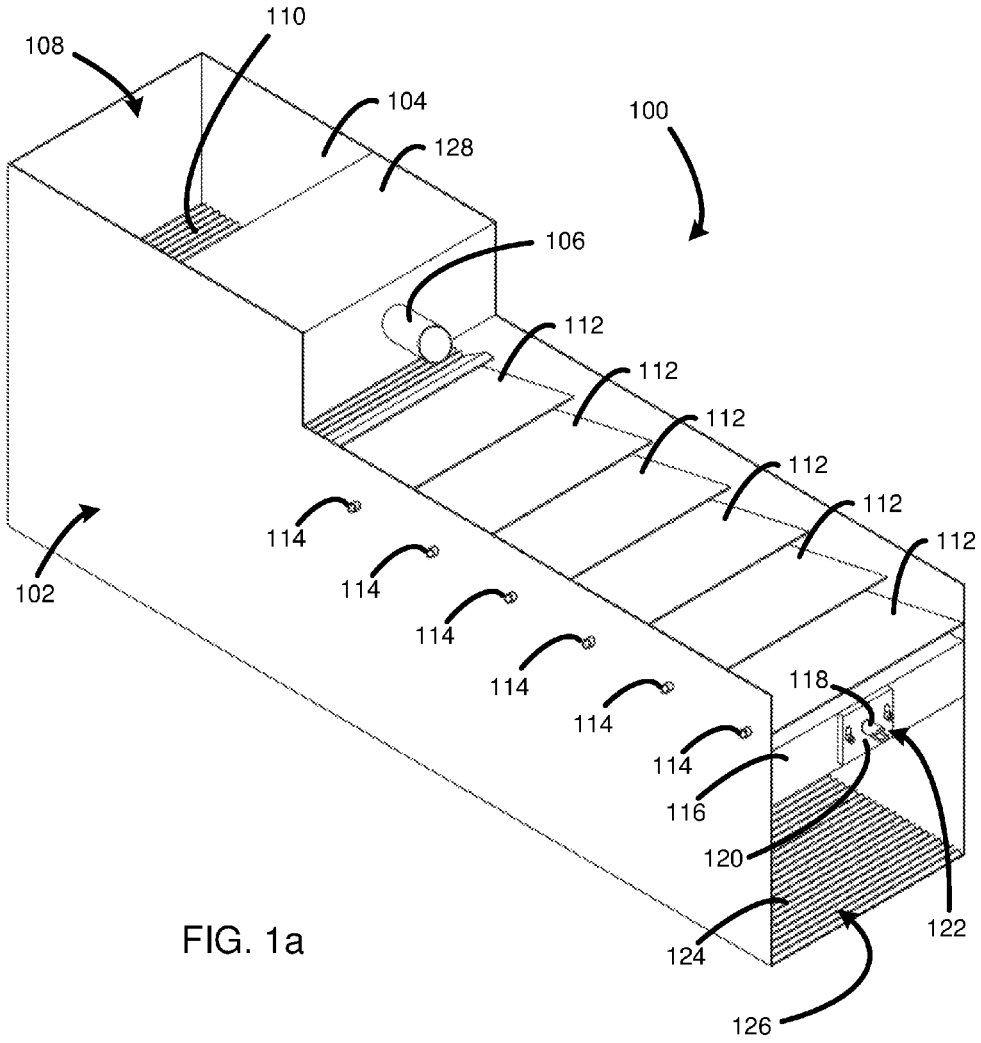
FIG. 1*a* is a perspective view of an exemplary louvered sluice according to the present disclosure.
Figure 1B:
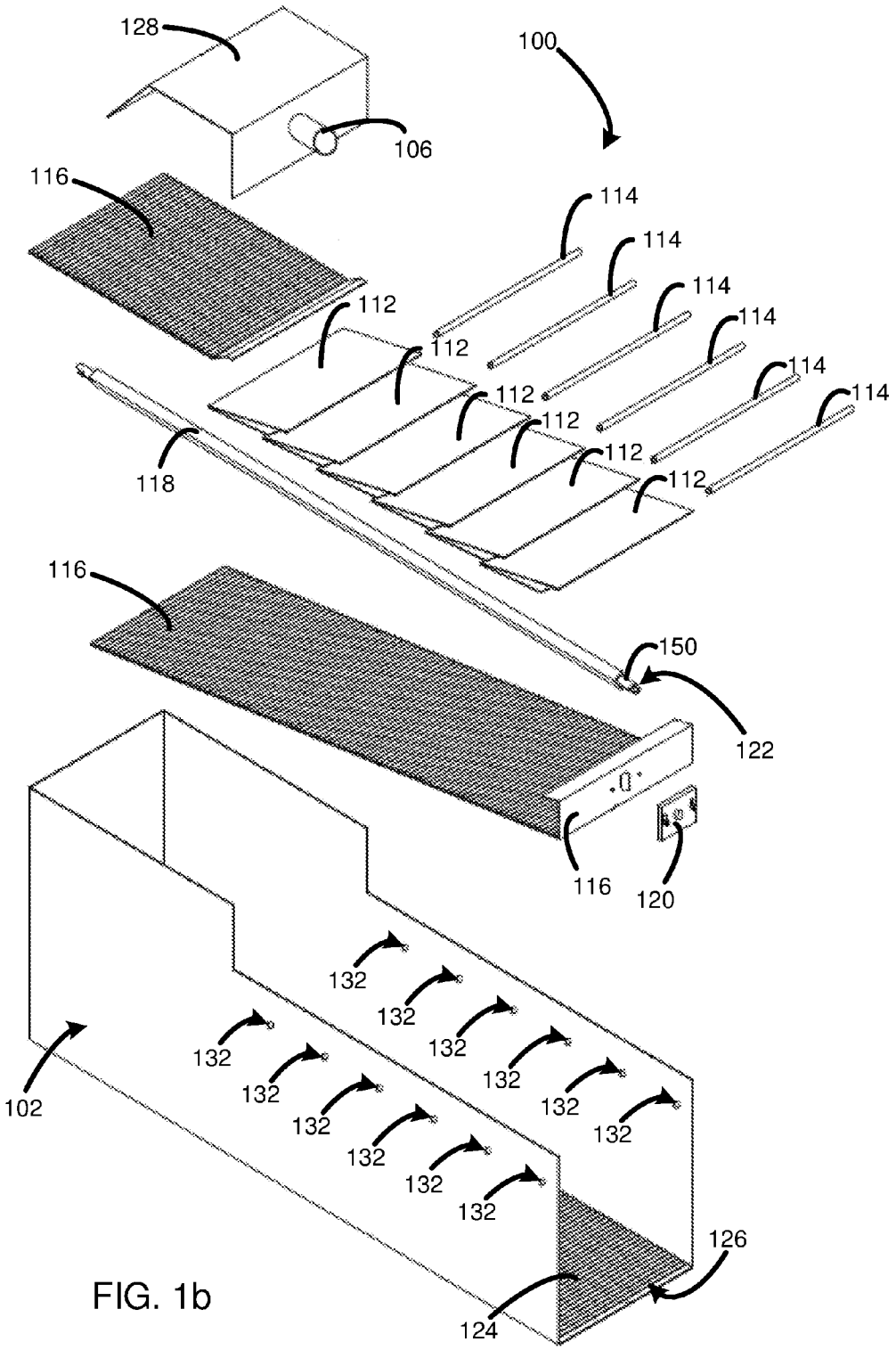
FIG. 1*b* is an exploded perspective view of the louvered sluice shown in FIG. 1*a*.

Referring primarily to FIGS. 1*a* and 1*b*, an exemplary embodiment of louvered sluice 100 is shown. The exemplary louvered sluice 100 has a bottom box 102, and a crash box 104. Water is introduced to crash box 104 through water inlet 106. The crash box 104 may have a crash box cover 128 to deflect water to the rear of crash box 104, and protect the water inlet 106. When oriented for operation the louvered sluice 100 may have a series of inclined surfaces that can be influenced by the physical orientation of the entire louvered sluice 100.

Mining material is deposited into a feed zone 160 that may comprise the exemplary crash box 104 through the material inlet 108. Crash box 104 may have a crash box base plate 110, which slopes towards a louvered processing zone 162. An appropriate flow of water through inlet 106 into crash box 108 agitates and moves the mining material along the inclined crash box base plate 110 and into louvered processing zone 162. The louvered processing zone 162 may slope in a similar direction to the crash box base plate 110. The louvered processing zone 162 of the exemplary embodiment may consist of a series of louvers 112 rotatably attached to louver pins 114. A plurality of louver pins 114 may be engaged in louver pinholes 132 on each side of the bottom box 102, and suspended across the body of bottom box 102. A louver pin 114 may suspend each louver 112 in the louvered processing zone 162 of bottom box 102. The series of louvers 112 may be oriented perpendicular to the anticipated flow of mining material and water.

A cam rod 118 may be positioned beneath the series of louvers 112. The cam rod 118 may be perpendicular to the series of louvers 112, and parallel to the anticipated flow of mining material and water. The cam rod 118 may engage the housing of the bottom box 102 at one end and a cam face plate 116 at the opposite end. The cam rod 118 may have a cam rod tip 150 that extends through the cam face plate 116 and through a cam bushing plate 120. The cam bushing plate 120 may support rotation of the cam rod 118 along the cam rod longitudinal axis α. A cam rod notch 122 in the cam rod tip 150 may permit mechanical advantage to be applied to the cam rod 118 in order to effect rotation about the cam rod longitudinal axis α.

A diverter plate 130 may be positioned under the crash box 104, series of louvers 112, and cam rod 118. The diverter plate 130 may be attached to the cam face plate 116 and slope downwardly away from the cam face plate 116 to the opposite end of the bottom box 102. In the exemplary embodiment, the diverter plate 130 does not extend all the way to the opposite end of the bottom box 102, but instead leaves an opening for fluids and material to flow off the inclined diverter plate 130 and onto the bottom box base plate 124. In the exemplary embodiment, bottom box base plate 124 is inclined so that material and water deposited off the diverter plate 130 may flow back toward the end of the bottom box 102 that houses the cam face plate 116. In the exemplary embodiment, sluice discharge 126, at the end of the bottom box base plate 124, may be positioned under cam face plate 116. In the exemplary embodiment, the crash box base plate 110, diverter plate 130, and the bottom box base plate 124 may each have a mining material collection mat, which may assist in capturing desired material.

Referring now primarily to FIGS. 2*a*, 2*b*, 2*c*, and 2*d*, a series of louvers 112 may be configured so as to be adjustably angled in pitch about the respective louver pin 114. In the exemplary embodiment, the louver pins may be seen as arranged along a line β that In the exemplary embodiments, each louver may have a louver top 134, a louver bottom 136, a flow edge 138, a drain edge 140, and a soffit 144. In the exemplary embodiment, the pitch of the louvers 112 may be seen as an angle θ upward from the cam rod axis α to a line Lt, which extends outward the louver top 134 perpendicular to the flow edge 138. In the exemplary embodiment, the louvers 112 are arranged in series perpendicular to the anticipated flow of water and mining material, which is roughly equivalent to the incline slope 158. So arranged in series, a pair of adjacent louvers 112 form a drain 142 between the louver bottom 136 and the drain edge 140 of the subsequent louver 112. A collecting zone 146 is formed between the soffit 144 of a first louver 112 and the louver top 134 of the subsequent louver 112.

In the exemplary embodiment the cam rod 118 is oriented perpendicular to the louvers 112 and may be positioned immediately under the series of louvers 112 such that the louver drain edge 140 may rest upon the cam rod surface 152. In the exemplary embodiment cam rod 118 may have a square cross sectional profile perpendicular to cam rod axis α. As such, the contour of the cam rod 118 may be seen to effect change in the angle θ of the louvers 112 by raising or lowering the drain edge 140. A raised contour on the cam rod surface 152 has the effect of raising the drain edge 140, reducing the angle θ. Conversely, a lowered contour on the cam rod surface 152 has the effect of lowering the drain edge 140, increasing the angle θ. In the exemplary embodiment, as the drain edge 140 experiences the flat side 154 and raised edge 156 of the cam rod's 118 square cross sectional profile the angle θ may vary between an angle that may be considered large and an angle that may be considered small, respectively.

Figure 2A:
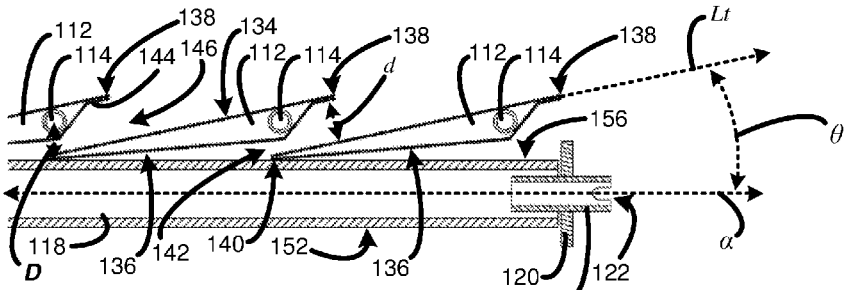
FIG. 2*a* is a partial side view of an exemplary louver assembly in a narrow position, cut through the longitudinal axis of the cam rod.
Figure 2B:
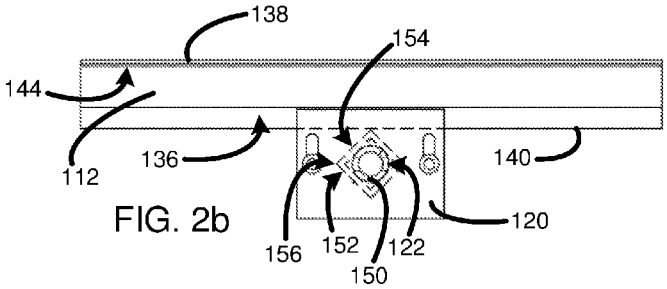
FIG. 2*b* is a partial end view of the louver assembly shown in FIG. 2*a* with the cam face plate removed.

Referring primarily to FIGS. 2*a* and 2*b*, the exemplary cam rod 118 is positioned such that the cam rod raised edge 156 is in contact with the drain edge 140 of the louvers 112. As such, angle θ is relatively small. Similarly, the distance d between the flow edge 138 and the louver top 134 of the subsequent louver 112, across collecting zone 146, is similarly relatively short. Similarly, the distance D between the louver pin 114 and the cam rod raised edge 156 is relatively small.

Figure 2C:
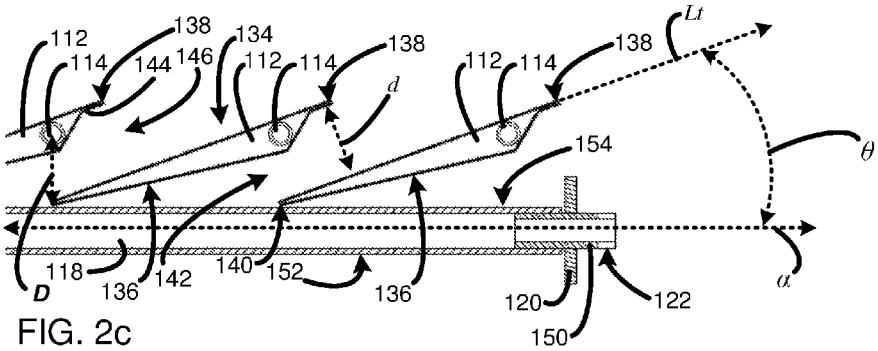
FIG. 2*c* is a partial side view of an exemplary louver assembly in a wide position, cut through the longitudinal axis of the cam rod.
Figure 2D:
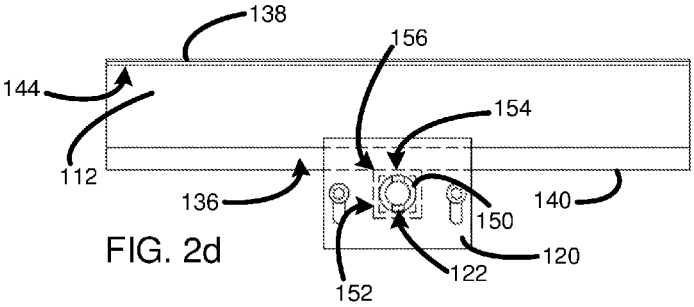
FIG. 2*d* is a partial end view of the louver assembly shown in FIG. 2*c* with the cam face plate removed.

Referring primarily to FIGS. 2*c* and 2*d*, the exemplary cam rod 118 is positioned such that the cam rod flat side 154 is in contact with the drain edge 140 of the louvers 112. As such, angle θ is relatively larger. Similarly, the distance d between the flow edge 138 and the louver top 134 of the subsequent louver 112, across collecting zone 146, is similarly relatively long. Similarly, the distance D between the louver pin 114 and the cam rod flat side 154 is relatively small.

Figure 3:
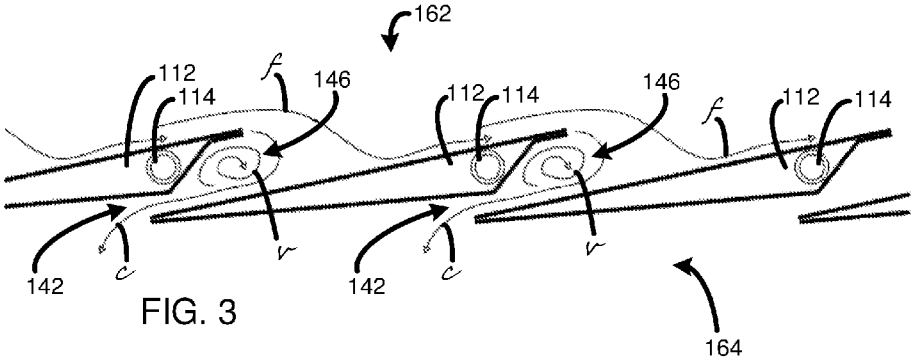
FIG. 3 is a schematic partial side view of an exemplary louver assembly shown with lines depicting theoretical material flow patterns.
Figure 4A:
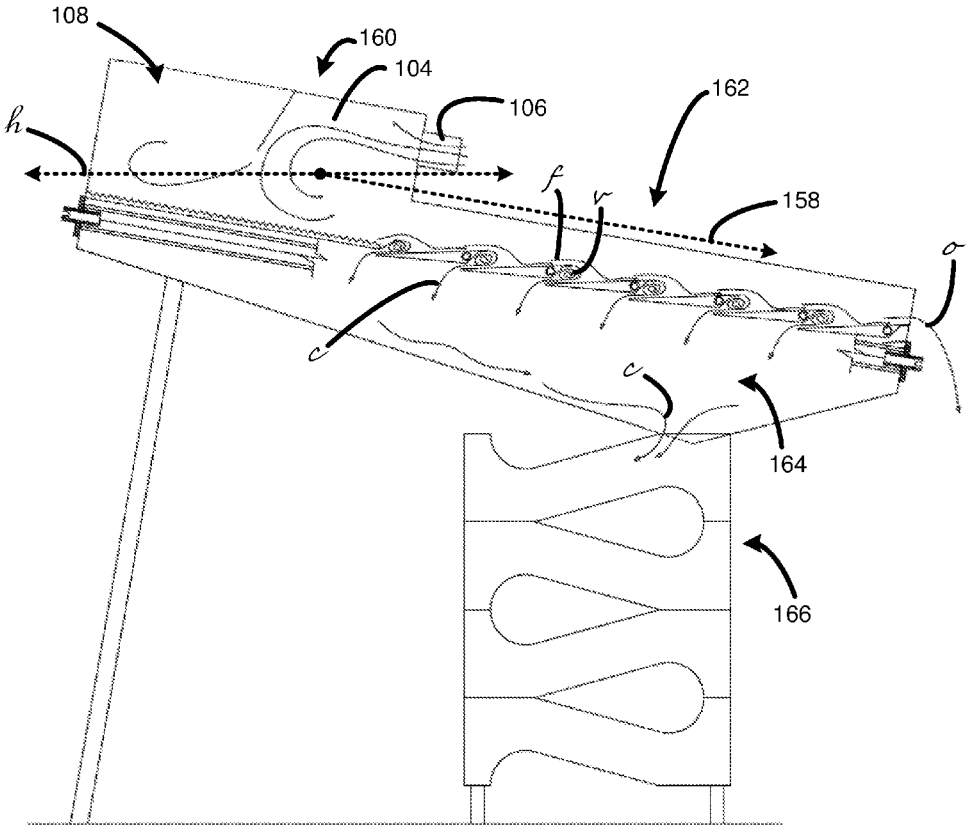
FIGS. 4*a* through 4*e* are schematic side views of envisioned operational integration options of the louvered sluice with existing material concentration sub-systems.
Figure 4B:
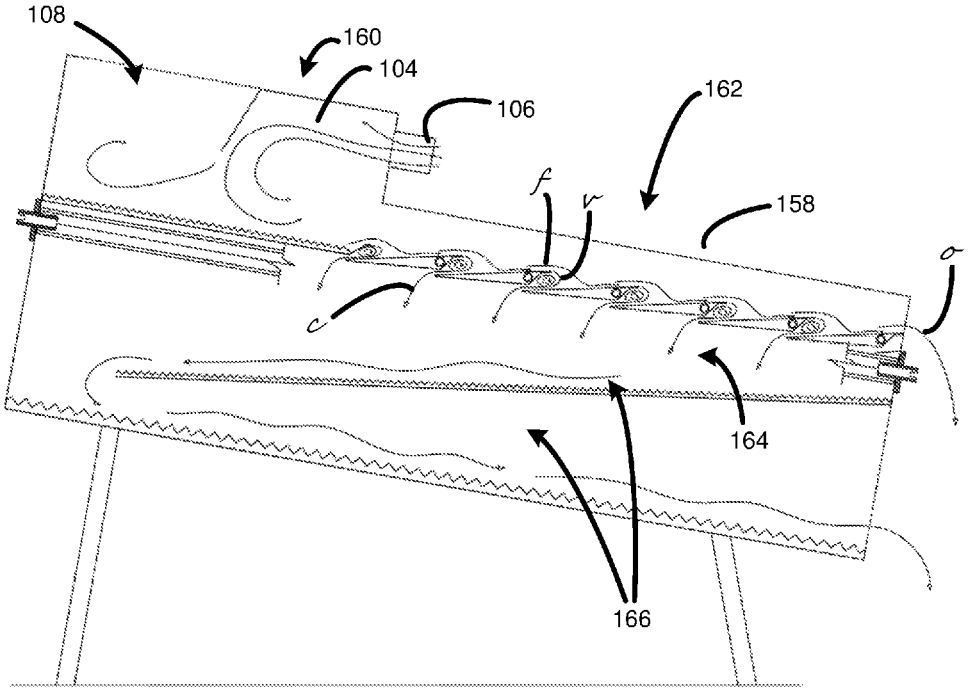
Figure 4C:
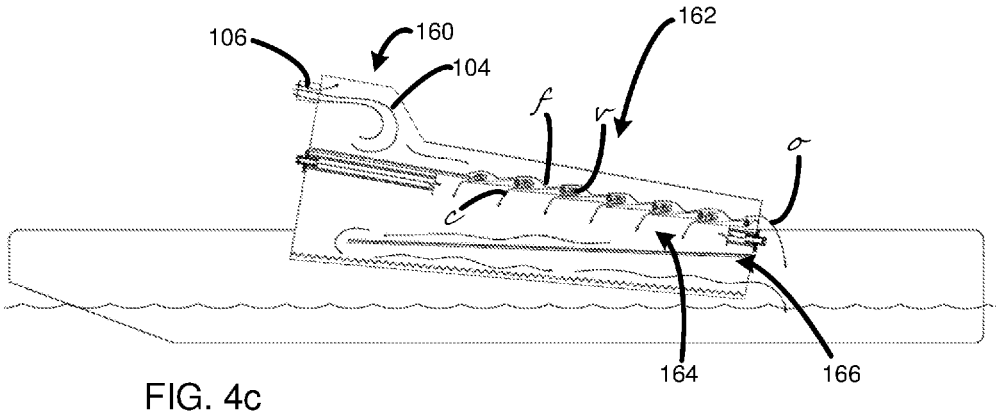
Figure 4D:
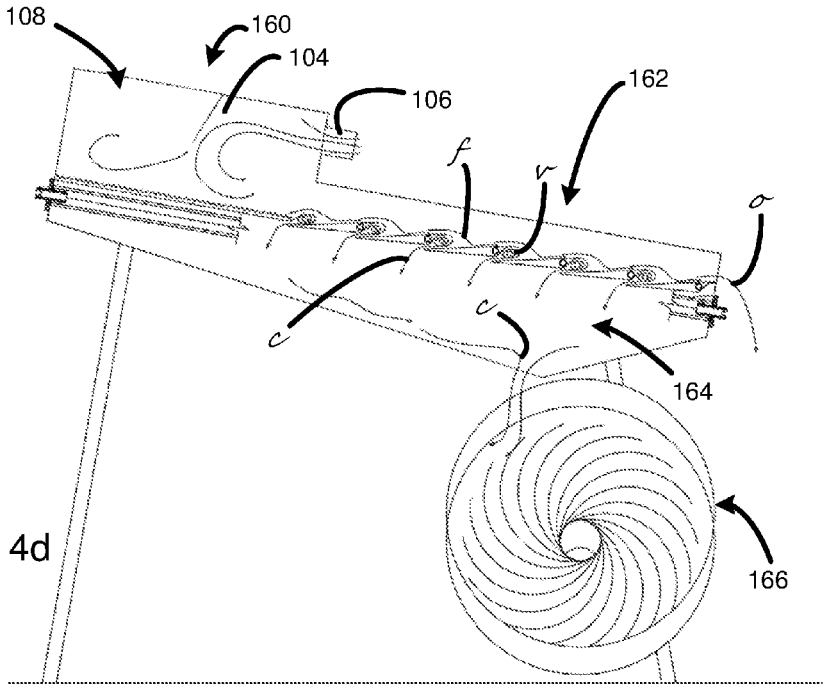
Figure 4E:
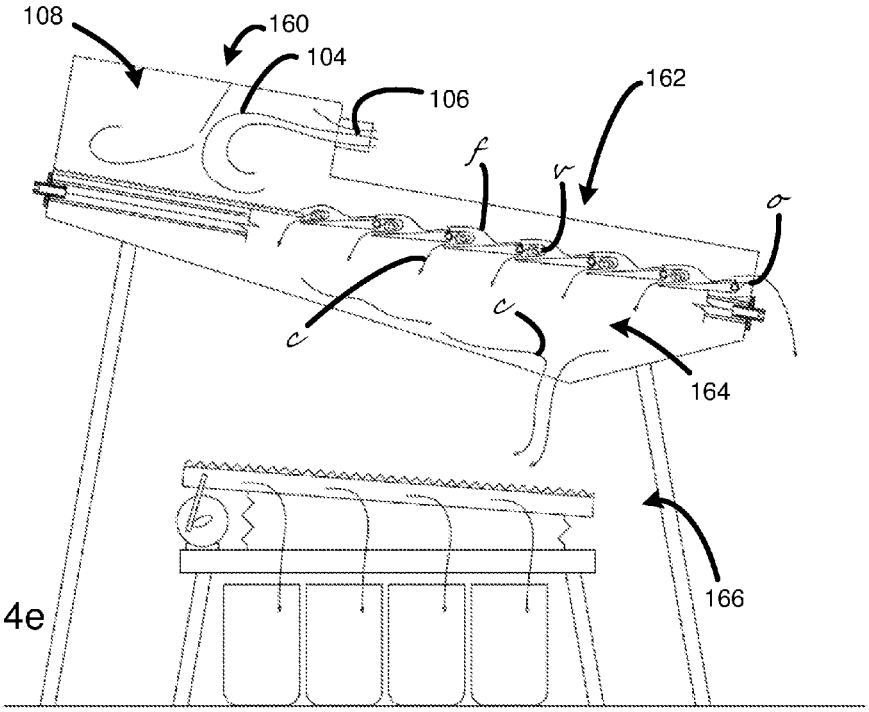

Referring now primarily to FIG. 3, exemplary flow paths across the louver processing zone 162 are depicted. The main processing flow f travels across the top of each louver top 134, and progresses to the louver top 134 of the subsequent louver 112. The materials that remain suspended in this processing flow f are not desired, and may include such things as tailings and light waste. Such materials flow off the end of the louver processing zone 162 with the wastewater as overflow o.

As the processing flow f experiences the flow edge 138, heavy, desirable materials may be drawn into the collecting zone 146 as vortex flow v. Vortex flow v works to separate out additional undesirable material, allowing it to rejoin the processing flow f. At the same time vortex flow v segregates the heavy, desirable materials, and allows them to pass through drain 142 in concentrate flow c, into the concentration zone 164. In the exemplary embodiment, the operator may adjust the intensity of the vortex flow v by adjusting the incline slope 158 of the louver processing zone 162, by adjusting the volume and velocity of the water in processing flow f, and by adjusting the angle θ of the series of louvers 112. It is understood that the exemplary incline slope 158 is a downward slope from a horizontal line h, which is generally parallel to the surface of the ground, or perpendicular to the directional force of gravity.

In the exemplary embodiment, concentrate flow c moves through concentration zone 164 and is captured by diverter plate 130, and subsequently directed to bottom box base plate 124. Concentrate flow c may then be directed as desired as it leaves sluice discharge 126. Alternately, concentrate flow c may be directed into subsequent processing devices in subsequent processing zone 166, as desired by the operator.

Mining operators may have varied equipment they may choose to use with the louvered sluice. The present system may be used in conjunction with such equipment. The following, shown in FIGS. 4*a* through 4*e*, present some non-exhaustive examples of how a louvered sluice may be incorporated into existing equipment sets.

FIG. 3*a* shows a "Gold Cube" device in the subsequent processing zone 166. FIG. 3*b* shows a "Finish Matting" device in the subsequent processing zone 166. FIG. 3*c* shows a "Dredge and Floating Dredge" system in the subsequent processing zone 166. FIG. 3*d* shows a "Spiral Wheel" device in the subsequent processing zone 166. FIG. 3*e* shows a "Shaker Table" device in the subsequent processing zone 166.

Figure 5A:
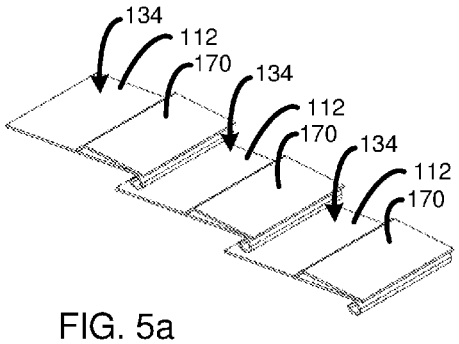
FIGS. 5*a* through 5*f* are schematic perspective views of alternate embodiments of louvers suitable for use with a louvered sluice according to the present disclosure.
Figure 5B:
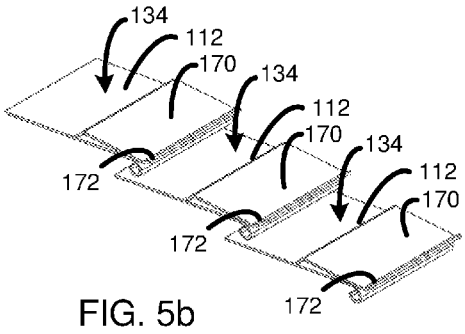
Figure 5C:
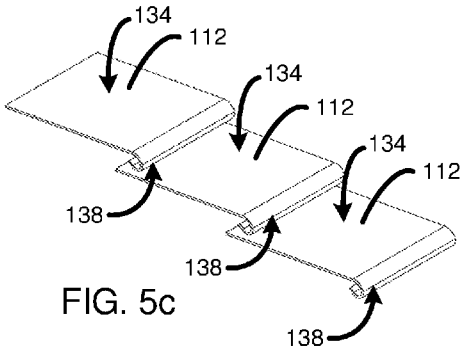
Figure 5D:
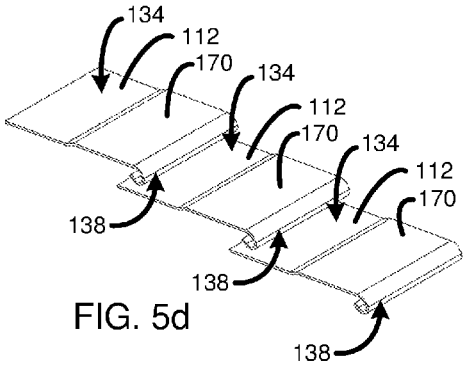
Figure 5E:
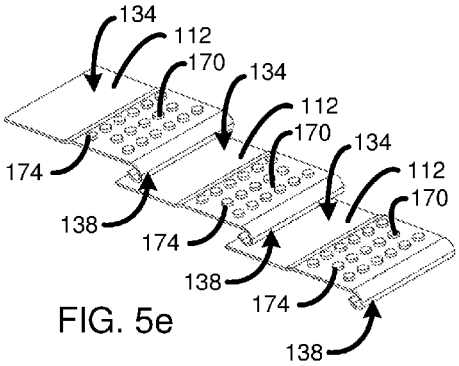
Figure 5F:
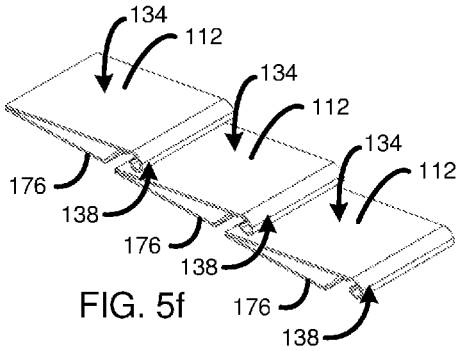

Referring now primarily to FIGS. 5*a* through 5*f*, non-exhaustive, alternate embodiments of the louvers 112 are offered. FIG. 5*a* shows an exemplary louver 112 where the louver top 134 may have a skid plate 170 to alter the processing flow f in a way that may be favorable to some mining operation. FIG. 5*b* shows an exemplary louver 112 where the louver top 134 has a skid plate 170 supplemented with a kick lip 172 at the flow edge 138. FIG. 5*c* shows an exemplary louver 112 where the flow edge 138 occurs proximate to the louver pin 114. FIG. 5*d* shows an exemplary louver 112 with a skid plate 170 on the louver top, as well as the flow edge 138 proximate to the louver pin 114. FIG. 5*e* shows an exemplary louver 112 with texture 174 on a skid plate 170. FIG. 5*f* shows an exemplary louver 112 with an extended bottom plate 176, which can be seen to alter the soffit 144, and therefore the collecting zone 146.

The exemplary embodiment may be described using the exemplary features described and shown in the corresponding illustrations. The corresponding illustrations may also be used to describe the exemplary embodiment in other manners. An exemplary description may include describing a mining sluice box that has an operational slope to support the movement of a processing flow of water and mining material, which may comprise a feed zone and a processing zone positioned along the operational slope, the processing zone downward on the operational slope from the feed zone, and the processing zone may comprise a plurality of louvers arranged parallel to each other, and positioned along and perpendicular to the operational slope. Additionally, each louvers may be angled away from the feed zone, where, in this sense, "away" is referring to the general orientation of the louver, where the top projects away from the feed zone. Additionally or alternatively, each louver may be adjustably angleable. Alternatively, the plurality of louvers may have a first louver positioned adjacent to a second louver, where adjacent does not include touching, each louver may have a flow edge and a drain edge, the drain edge being closer to the feed zone than the flow edge, and the second louver drain edge being closer to the feed zone than the first louver flow edge. Additionally, each louver may have a louver pin parallel to and distal from the drain edge, a cam rod parallel to the operational slope from the feed zone through the processing zone, the drain edge of a first louver in contact with the cam rod surface, the cam rod having a first position removed a first distance from the louver pin of the first louver and a second position removed a second distance from the louver pin of the first louver, and the first louver having a first angle upward from the operational slope with the cam rod in the first position and a second angle upward from the operational slope with the cam rod in the second position. Additionally, wherein the first distance is greater than the second distance, and the first angle upward is greater than the second angle upward.

Alternatively, the mining sluice box may further comprise a cam rod parallel to the operational slope from the feed zone through the processing zone, the cam rod may have a longitudinal axis, and a cam rod surface may have a raised feature and a low feature, at least one louver drain edge in contact with the cam rod surface, the plurality of louvers may have a first angle upward from the cam rod axis with the at least one drain edge in contact with the low feature of the cam rod surface and a second angle upward from the cam rod axis with the at least one drain edge in contact with the raised feature of the cam rod surface, and the first angle upward is greater than the second angle upward.

Alternatively and additionally, the mining sluice box may further comprise each louver may have a top surface and a flow edge, the top surface may have a top surface plane, each louver having a louver pitch, the louver pitch is an angle up from a plane through the operational slope that is perpendicularly parallel to the top slope plane to the top slope plane, and the louver pitch is greater than 0 degrees, and less than 90 degrees.

Additionally and alternatively, a mining sluice box be seen as comprising a feed zone, a processing zone, and a concentration zone, the processing zone may have an operational inclined slope downward from the feed zone, the concentration zone may be operationally positioned directly below the processing zone, so as to facilitate flow movement of the water and mining material, the processing zone may comprise a plurality of louvers positioned horizontally perpendicular to the operational inclined slope, each louver including a flow edge and a drain edge, with the flow edge of each louver further from the feed zone than the drain edge of that louver, a first louver may have a drain edge closer to the feed zone than a drain edge of a second louver, and the first louver may have a flow edge further from the feed zone than the drain edge of the second louver. Additionally, the mining sluice box may further comprise a cam rod parallel to the operational inclined slope, the cam rod may have a longitudinal axis, and a cam rod surface may have a raised feature and a low feature, at least one louver drain edge may be in contact with the cam rod surface, the plurality of louvers may have a first angle upward from the cam rod axis with the at least one drain edge in contact with the low feature of the cam rod surface and a second angle upward from the cam rod axis with the at least one drain edge in contact with the raised feature of the cam rod surface, and the first angle upward is greater than the second angle upward The exemplary embodiment is describe in U.S. patent application No. 62/215,282, filed 8 Sep. 2015 by the present inventor, which is hereby incorporated by reference in order to ensure any patentable subject matter therein disclosed is available as teaching to this disclosure.

These examples illustrate only a few configurations that are considered by the inventor within the scope of this disclosure. The foregoing disclosure and description of the invention is illustrative and explanatory thereof. Various changes in the details of the illustrated construction may be made, including varied combinations of the disclosed alternate embodiments, within the scope of the appended claims without departing from the spirit of the invention. The present invention should only be limited by the following claims and their legal equivalents.

I claim:

1. A mining sluice box comprising:

a feed zone, a processing zone, and a concentration zone;

the processing zone having an operational inclined slope downward from the feed zone;

the concentration zone operationally positioned directly below the processing zone;

the processing zone comprising a plurality of rotatably adjustable louvers positioned horizontally perpendicular to the operational inclined slope;

each louver including a flow edge and a drain edge, with the flow edge of each louver further from the feed zone than the drain edge of that louver;

a first louver having a drain edge closer to the feed zone than a drain edge of a second louver; and the first louver having a flow edge further from the feed zone than the drain edge of the second louver.

2. The mining sluice box of claim 1, further comprising:

a cam rod parallel to the operational inclined slope;

the cam rod having a longitudinal axis, and a cam rod surface having a raised feature and a low feature;

at least one louver drain edge in contact with the cam rod surface;

the plurality of louvers having a first angle upward from the cam rod axis with the at least one drain edge in contact with the low feature of the cam rod surface and a second angle upward from the cam rod axis with the at least one drain edge in contact with the raised feature of the cam rod surface; and the first angle upward being greater than the second angle upward.

* * * * *